US006322240B1

(12) United States Patent
Omasa

(10) Patent No.: US 6,322,240 B1
(45) Date of Patent: Nov. 27, 2001

(54) VIBRATIONALLY FLUIDLY STIRRING APPARATUS

(75) Inventor: Ryushin Omasa, Fujisawa (JP)

(73) Assignee: Japan Techo Co., LTD (JP)

( * ) Notice: Subject to any disclaimer, the term of this patent is extended or adjusted under 35 U.S.C. 154(b) by 0 days.

(21) Appl. No.: 09/552,194

(22) Filed: Apr. 19, 2000

(30) Foreign Application Priority Data

May 7, 1999 (JP) ..... 11-127830

(51) Int. Cl.[7] ..... B01F 11/00

(52) U.S. Cl. ..... 366/118; 366/256; 366/332; 366/347

(58) Field of Search ..... 366/118, 117, 366/243, 255, 256, 257, 258, 259, 260, 276, 347, 332, 333, 334, 335, 242

(56) References Cited

U.S. PATENT DOCUMENTS 1,265,187 * 5/1918 Fleming .
2,281,094 * 4/1942 Chambers .
2,417,372 * 3/1947 Morris .
2,508,950 * 5/1950 Kaplan .
2,615,692 * 10/1952 Muller .
3,384,354 * 5/1968 Migule et al. .
3,567,185 * 3/1971 Ross et al. .
3,861,653 * 1/1975 Becheiraz .
4,259,021 * 3/1981 Goudy, Jr. .
5,375,926 12/1994 Omasa ..... 366/118
5,730,856 3/1998 Omasa .
6,007,237 * 12/1999 Latto .

FOREIGN PATENT DOCUMENTS

3628012 A1 2/1988 (DE) .
8-173785 * 7/1996 (JP) .

OTHER PUBLICATIONS

Patent Abstracts of Japan, vol. 1996, No. 11, (11/96) & JP 08 173785 (Nippon Techno KK), 7/96, Agitating Device, Abstract in English.
European Search Report listing references, EP 00 10 9545.

* cited by examiner

*Primary Examiner*—Tony G. Soohoo
(74) *Attorney, Agent, or Firm*—Pitney, Hardin, Kipp & Szuch, LLP

(57) ABSTRACT

A vibrationally fluidly stirring apparatus includes tank (13) to be charged with liquid (LIQ) to be stirred; a vibration generating portion containing vibration motor (14); vibration absorbing member (3) disposed between the tank (13) and the vibration generating portion; a vibrating bar (7) operationally connected to the vibration generating portion and extended in the tank (13); and a vibration vane (10) attached to the vibrating bar (7), the vibration absorbing member (3) is a laminate of upper metal plate (1), rubber plate (2) and lower metal plate (1').

6 Claims, 10 Drawing Sheets

VIBRATIONALLY FLUIDLY STIRRING APPARATUS

BACKGROUND OF THE INVENTION

1. Field of the Invention

The present invention relates to a vibrationally fluidly stirring apparatus having a vibration vane which is vibrated in fluid such as liquid to generate vibrational flow in the fluid.

2. Description of the Related Art

The inventor has proposed a method of stirring fluid with high efficiency in which vibration generated by a vibration motor disposed at the outside of a tank to be charged with the fluid is transmitted to a vibration motor mount member, then to a vibration vane disposed in the fluid via a vibrating bar so as to vibrate the vibrating vane at an amplitude of 8 to 20 mm and at a vibrational frequency of 200 to 600 times per minute, as shown in JP3-275130(A), for example.

In the above method, as shown in FIGS. 9A and 9B, the vibration motor mount plate 40 is supported on support members 18 attached to the upper edge of the tank 13 via four coiled springs 21, within each of which is received upper guide rod 23 fixed to the vibration motor mount plate 40 and lower guide rod 24 fixed to the support member 18. Therefore, when the apparatus is operated, the load excerted on each coiled spring 21 becomes great and the noise occurring due to the mechanism of coiled spring and the neighborhood thereof is considerable. In addition, when the apparatus is moved or transported, the upper portion of the coiled spring 21 and the lower portion thereof tends to become in disalignment with each other as shown in FIGS. 10B, 10C from the ordinary state shown in FIG. 10A, and furthermore the upper guide rod 23 often falls off the lower guide rod 24. It is difficult to recover the alignment of the upper and lower portions of the coiled spring 21 of FIGS. 10B, 10C.

It would be considered that a tubular rubber member having the same shape is used instead of the coiled spring 21, however, the tubular rubber member is insufficient to substitute for the coiled spring because the tubular rubber member cannot maintain its shape in a vertical direction when the vibration in the vertical direction is excerted on the tubular rubber member. If the tubular metallic member is attached to the outer surface of the tubular rubber member in order to maintain its shape in the vertical direction, the heat generation occurs due to the friction between the tubular metallic member and the tubular rubber member.

SUMMARY OF THE INVENTION

An object of the present invention is to provide a vibrationally fluidly stirring apparatus having a vibration absorbing member which is constituted without coiled spring made of metal.

According to the present invention, in order to attain the above object, there is provided a vibrationally fluidly stirring apparatus comprising a tank for accommodating fluid; a vibration generating portion containing a vibrator; a vibration absorbing member disposed between the tank and the vibration generating portion; a vibrating bar operationally connected to the vibration generating portion and extended in the tank; and a vibration vane attached to the vibrating bar, wherein the vibration absorbing member comprises a rubber plate or a laminate of rubber plate and metal plate.

The vibrator may be a vibration motor. The vibration generating portion and the vibrating bar may be attached to the vibration absorbing member. At least one rubber plate may comprise a sponge rubber layer and a solid rubber layer. The vibration absorbing member may be positioned on a portion of the upper edge of the tank. The vibration absorbing member may be positioned on the entirety of the upper edge of the tank. The vibration absorbing member may be positioned so as to seal the upper opening of the tank. The vibrating bar may pass through a hole formed in the vibration absorbing member in such a manner that the outer surface of the vibrating bar is in contact with the inner face of a hole formed in the rubber plate. The vibrationally fluidly stirring apparatus of the present invention may further comprise an inverter for controlling the vibrator to generate any frequency in the range from 10 to 500 Hz.

The fluid to be stirred by the apparatus of the present invention is typically a liquid, but is not restricted thereto and may be powder.

The rubber plate or the laminate of the rubber and metal plate as the vibration absorbing member functions in such a manner that the rubber plate absorbs the vibration generated by the vibration generating portion containing the vibrator, the rubber plate or both the rubber plate and the metal plate hold the weight of the vibration generating portion, and the vibration is transmitted efficiently to the vibrating bar. The rubber plate and the metal plate in the laminate may be adhered to each other by adhesive or may be merely stacked to form the laminate.

The thickness of the laminate is so determined as to be capable of holding the weight of the vibration generating portion and absorbing the vibration appropriately so as to be efficiently transmitted to the vibrating bar and the vibration vane.

As compared with the conventional vibrationally fluidly stirring apparatus having coiled spring type vibration absorbing member, the apparatus according to the present invention has the following advantages:

There is no trouble explained with reference to FIGS. 10B to 10C in moving or transporting the apparatus, because the vibration absorbing member does not use coiled springs, but uses a rubber plate or a laminate of rubber plate and metal plate.

Furthermore, it is possible to seal the tank with the vibration absorbing member and therefore, even if flammable gas is generated from the fluid in the tank when stirring, the danger of explosion is very low without costs for employing the explosion-proof type vibrator;

it is possible to suppress the vaporization of volatile solvent such as lacquer, methyl ethyl ketone, methyl isobutyl ketone, ethers, esters such as ethyl acetate in the fluid, and to prevent leakage of odorous vapor from the tank to the outside;

it is possible to prevent inflow of contaminant with air into the tank and therefore it is suitable to use the apparatus in treatment of food and drink;

it is possible to charge the tank fully with the fluid so that the treatment performance becomes higher, because the fluid was not scattered to the outside of the tank even if the high vibrational frequency or high vibrational force is used; and it is possible to lower the noise level even if the high vibrational frequency or high vibrational force is used.

DETAILED DESCRIPTION OF THE PREFERRED EMBODIMENTS

Embodiments of the vibrationally fluidly stirring apparatus according to the present invention will be described with reference to the drawings.

Figure 1:
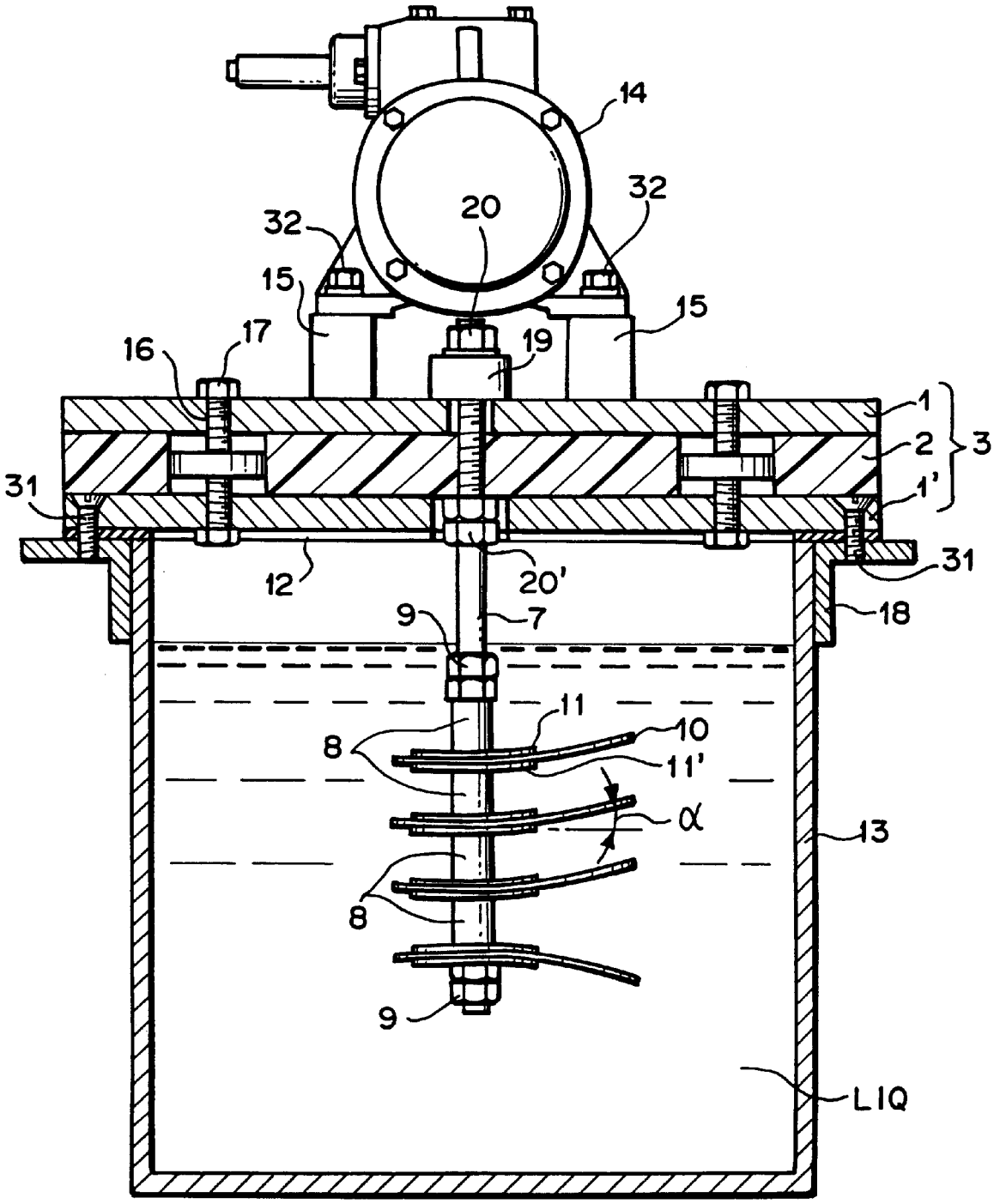
FIG. 1 is a cross-sectional view showing an embodiment of a vibrationally fluidly stirring apparatus according to the present invention.
Figure 2:
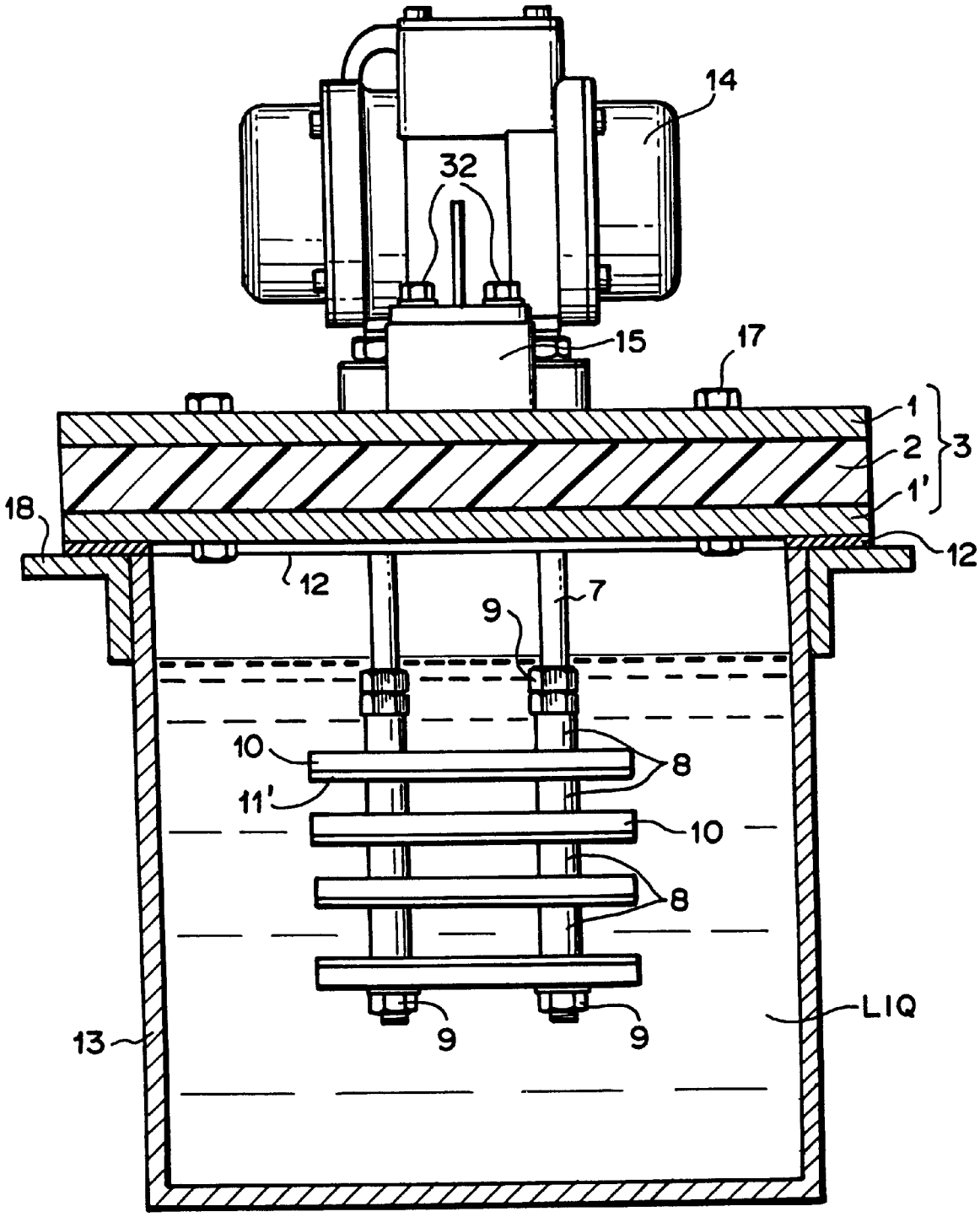
FIG. 2 is a cross-sectional view showing the embodiment of the vibrationally fluidly stirring apparatus according to the present invention.
Figure 3:
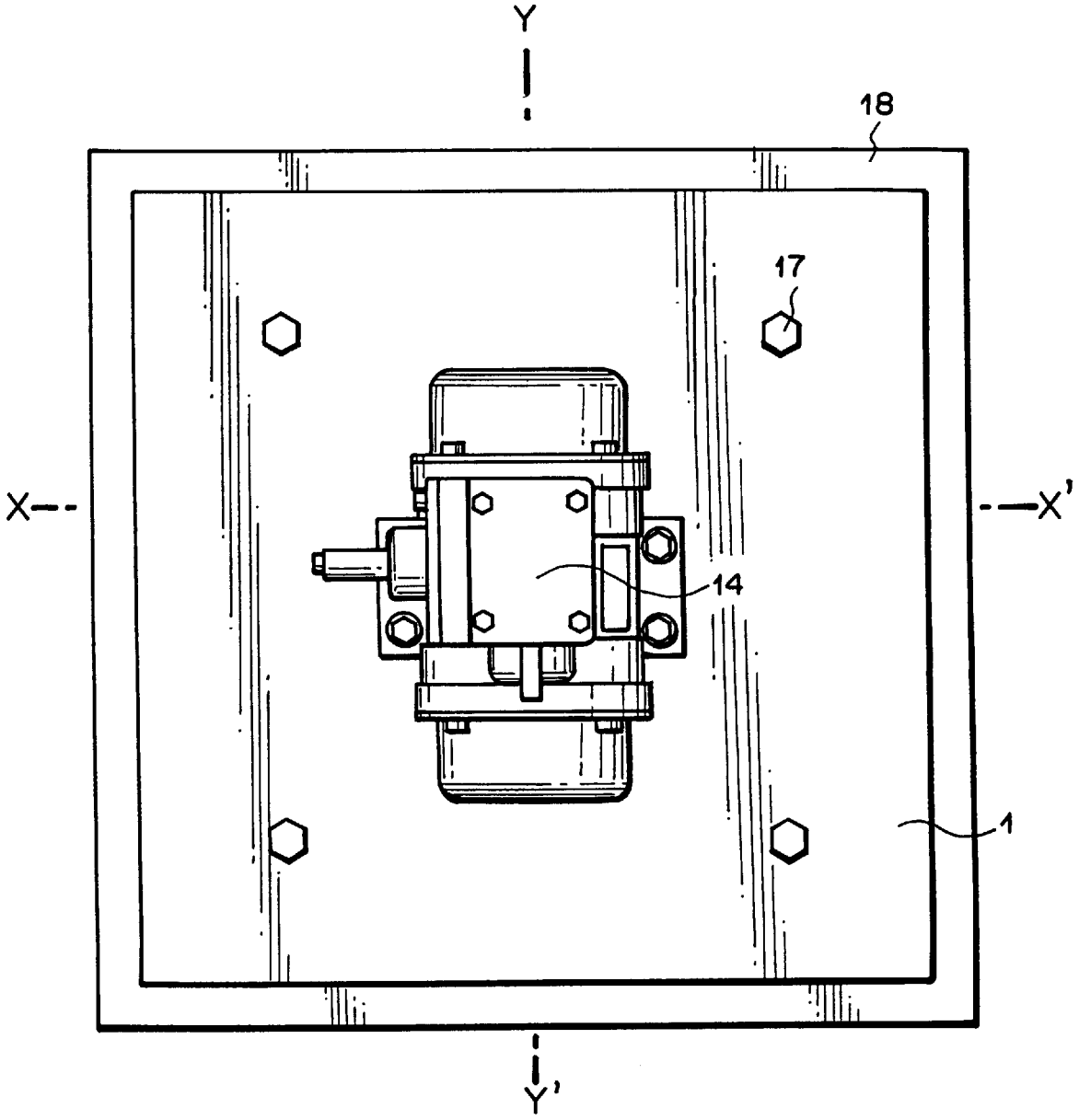
FIG. 3 is a plan view of the vibrationally fluidly stirring apparatus according to the present invention.

FIGS. 1 and 2 are each a cross-sectional view of an embodiment of the vibrationally fluidly stirring apparatus of the present invention, and FIG. 3 is a plan view of this embodiment. FIGS. 1 and 2 are views taken along lines X–X' and Y–Y' of FIG. 3, respectively.

In FIGS. 1 to 3, reference numeral 13 denotes a tank which is charged with a liquid LIQ to be stirred. Reference numeral 18 denotes a support member fixed to the upper edge of the tank 13. Reference numerals 14 and 15 denote a vibration motor and a vibration motor mount member, respectively. These constitute a vibration generating portion.

Reference numerals 1 and 1' denote an upper metal plate and a lower metal plate, reapectively, and reference numeral 2 denotes a rubber plate. These constitute vibration absorbing member 3, which is disposed between the vibration generating portion and the tank 13. The upper and lower metal plates 1, 1' and the rubber plate 2 are fixed by means of bolts 16 and nuts 17 to form a laminate.

The vibration absorbing member 3 is attached to the tank 13 in such a manner that the lower metal plate 1' and the support member 18 are fixed to each other by bolts 31 with packing 12 interposed therebetween. The vibration generating portion is mounted on the vibration absorbing member 3 at a central position thereof away from the support member 18 in such a manner that the vibration motor 14 and the upper metal plate 1 are fixed to each other via the mount member 15 by bolts 32.

Reference numeral 7 denotes a vibrating bar, the upper portion of which is connected to the vibration absorbing member 3 at the central position thereof with use of nuts 20, 20' and rubber ring 19 used as a vibrational stress dispersing means. Reference numeral 10 denote a vibration vane attached to the vibrating bar 7. On the vibrating bar 7, spacers 8 are disposed between the neighboring vibration vanes 10. The vibration vanes 10 each held by upper and lower vibration vane fixing members 11 and 11' are positioned at a certain interval. Reference numeral 9 denotes a nut for holding the spacers 8, vibration vanes 10 and vibration vane fixing members 11, 11' on the vibrating bar 7.

Examples of material of the metal plates 1, 1' are stainless steel, iron, copper, aluminum, suitable alloys, etc. The thickness of the metal plates 1, 1' is 10 to 40 mm for example.

Material of the rubber plate 2 is, for example, synthetic rubber or vulcanized natural rubber, and preferably rubber vibration isolator defined in JIS K6386(1977).

Examples of synthetic rubber are chloroprene rubber, nitrile rubber, nitrile-chloroprene rubber, styrene-chloroprene rubber, acrylonitrile-butadiene rubber, isoprene rubber, ethylene-propylene-diene rubber, epichlorohydrin rubber, alkylene oxide rubber, fluororubber, silicone rubber, urethane rubber, polysulfide rubber, phosphorus rubber (flame-retarded rubber).

Examples of the rubber plate available in market are natural rubber plate, insulating rubber plate, electrically conductive rubber plate, oil-resistant rubber (e.g. NBR), chloroprene rubber plate, butyl rubber plate, chlorinated rubber plate, SBR rubber plate, silicone rubber plate, fluororubber plate, acrylic rubber plate, ethylene-propylene rubber plate, urethane rubber plate, epichlorohydrin rubber plate, fire-retardant rubber plate. It is preferable to use rubber plate made of material having properties of rubber vibration isolator defined in JIS K6386(1977), especially having static modulus of elasticity in shear of 4 to 22 $kgf/cm^2$, preferably 5 to 10 $kgf/cm^2$, and ultimate elongation of 250% or more.

The thickness of the rubber plate 2 is 5 to 60 mm for example.

Figure 4A:
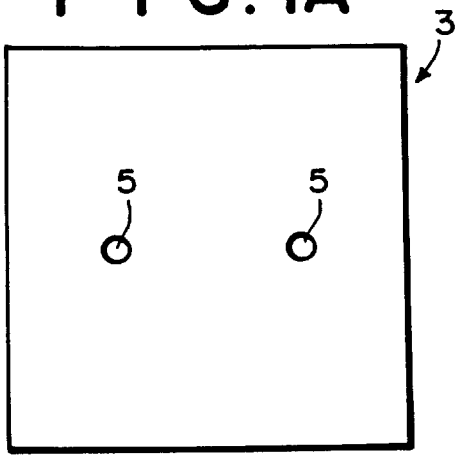
FIG. 4A shows a schematic plan view of a vibration absorbing member.

FIG. 4A shows a schematic plan view of the vibration absorbing member 3. In FIG. 4A, reference numeral 5 denotes a hole through which the vibrating bar 7 passes. The vibration absorbing member 3 seals the upper opening of the tank 13. The inner diameter of the hole portion of rubber plate 2 which is a part of the hole 5 of the vibration absorbing member 3 is substantially equal to the diameter of the vibrating bar 7, while the inner diameter of a hole of the metal plates 1, 1' which is a part of the hole 5 of the vibration absorbing member 3 is slightly greater than the diameter of the vibrating bar 7 as shown in FIG. 4D.

Figure 4B:
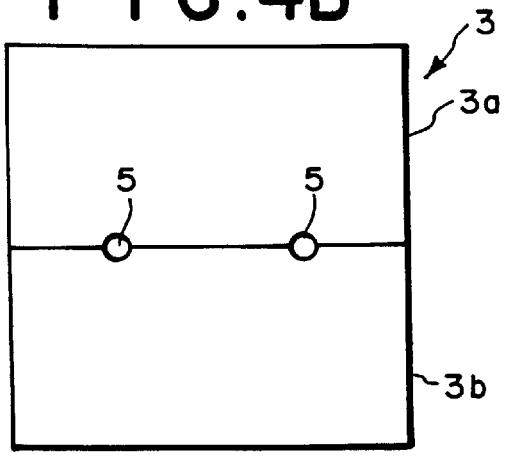
FIGS. 4B and 4C show a schematic plan view of variations of the vibration absorbing member.
Figure 4C:
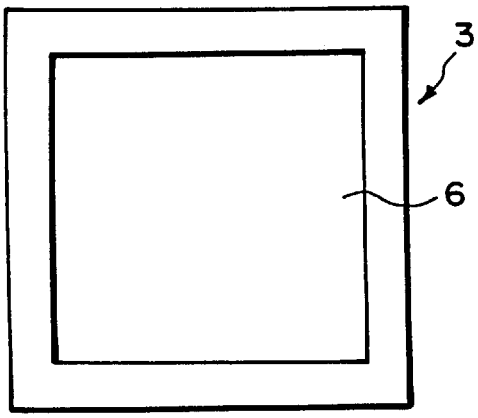

FIGS. 4B and 4C show a schematic plan view of variations of the vibration absorbing member 3. The vibration absorbing member 3 of FIG. 4B comprises the first portion 3*a* and the second portion 3*b*, the facing edges of which are contacted with each other. The vibration absorbing member 3 of FIG. 4C has opening 6 while being positioned on the entirety of the upper edge of the tank 13.

Figure 4D:
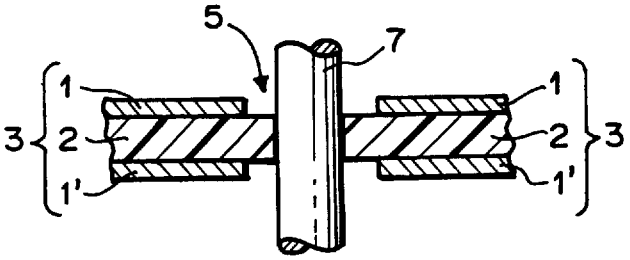
FIGS. 4D and 4E show a cross-sectional view of the vibration absorbing member.
Figure 4E:
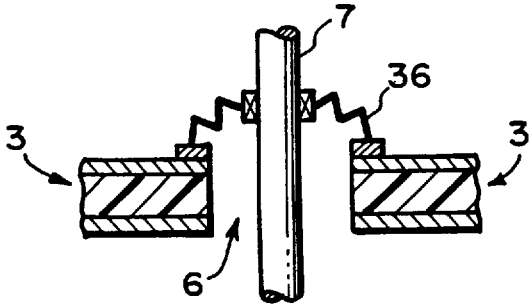

FIGS. 4D and 4E show a cross-sectional view of the vibration absorbing member 3. As shown in FIG. 4E, a flexible sealing member 36 made of soft rubber, etc. may be used to perform perfect seal at a portion where the vibrating bar 7 passes through the opening 5 or 6 of the vibration absorbing member 3. Such a perfect seal is advantageous if the apparatus is used for vibrationally fluidly stirring of any fluid which cause a generation of harmful gas.

Also in case where the flexible sealing member is not used as shown in FIG. 4D, a sufficient seal can be performed on the basis of the function of the rubber plate 2 of the vibration absorbing member 3 in that the expansion and contraction of the rubber plate 2 can follow the motion of the vibrating bar 7 to the considerable extent and the frictional heat thus generated is small, because the amplitude of vibration of the vibrating bar 7 is 2 to 30 mm, preferably 5 to 20 mm, more preferably 10 to 15 mm.

Figure 5A:
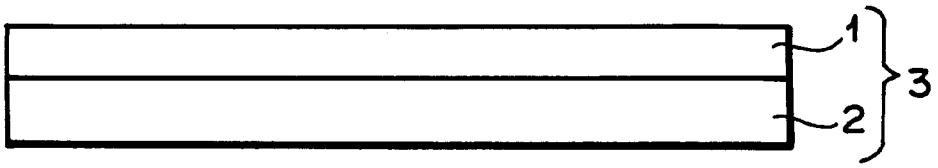
FIGS. 5A to 5E show front view of examples of the vibration absorbing member.
Figure 5B:
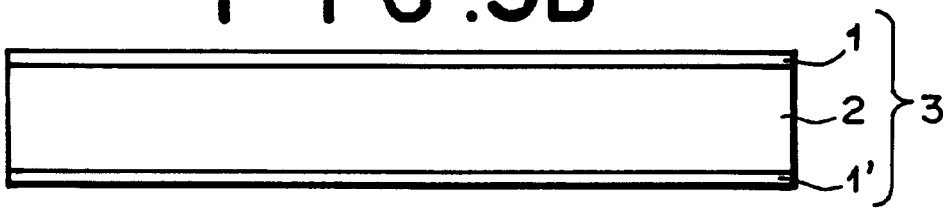
Figure 5C:
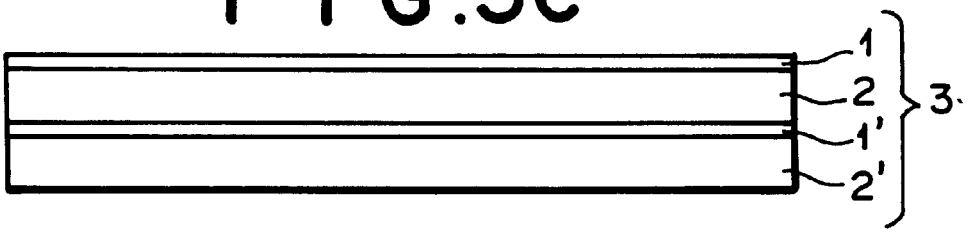
Figure 5D:
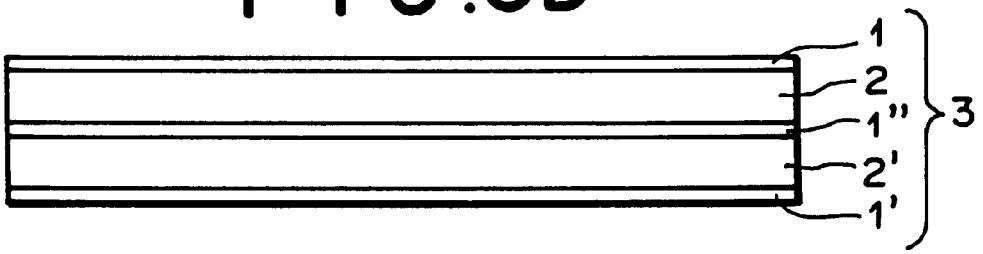
Figure 5E:
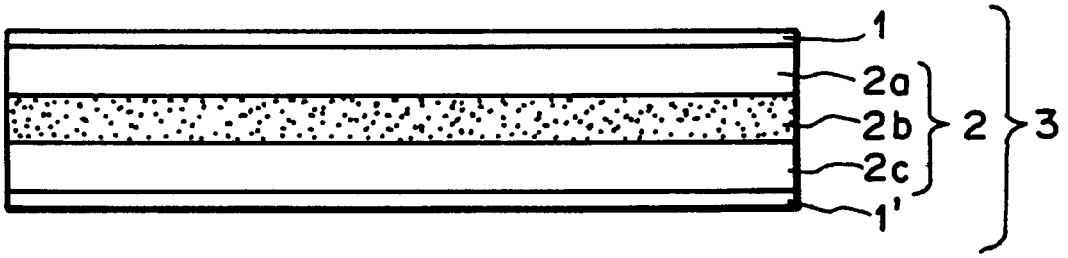

FIGS. 5A to 5E show front view of examples of the vibration absorbing member 3. The vibration absorbing member 3 of FIG. 5B is the same as that of FIGS. 1 and 2. The vibration absorbing member 3 of FIG. 5A comprises metal plate 1 and rubber plate 2. The vibration absorbing member 3 of FIG. 5C comprises upper metal plate 1, upper rubber plate 2, lower metal plate 1' and lower rubber plate 2'. The vibration absorbing member 3 of FIG. 5D comprises upper metal plate 1, upper rubber plate 2, intermediate metal plate 1", lower rubber plate 2' and lower metal plate 1'. The thickness of the intermediate metal plate 1" is 0.3 to 10 mm for example, while the thickness of the upper and lower metal plates 1, 1' is rather large, 10 to 40 mm for example as mentioned above, since the upper metal plate 1 supports the vibration generating portion and the lower metal plate 1' is secured to the support member 18. The vibration absorbing member 3 of FIG. 5E comprises upper metal plate 1, lower metal plate 1', and rubber plate 2 which comprises an upper solid rubber layer 2*a,* sponge rubber layer 2*b* and lower solid rubber layer 2*c.* One of the upper and lower solid rubber layer 2*a,* 2*c* may be omitted. Alternatively, a plurality of sponge rubber layers and a plurality of solid rubber layers may be used in the rubber plate. The vibration absorbing member 3 may be formed of a rubber plate.

Figure 6A:
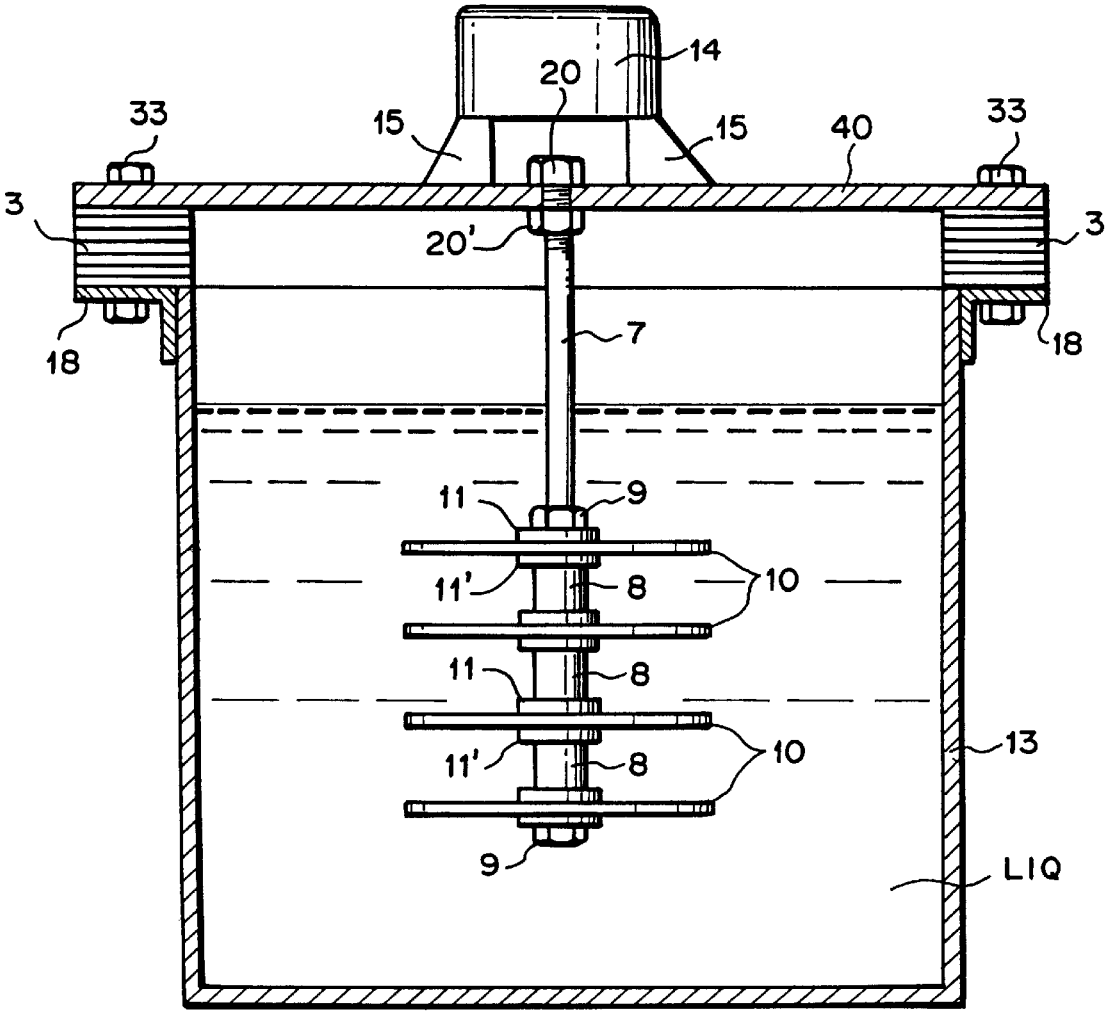
FIG. 6A shows a cross-sectional view of another embodiment of the vibrationally fluidly stirring apparatus of the present invention.
Figure 6B:
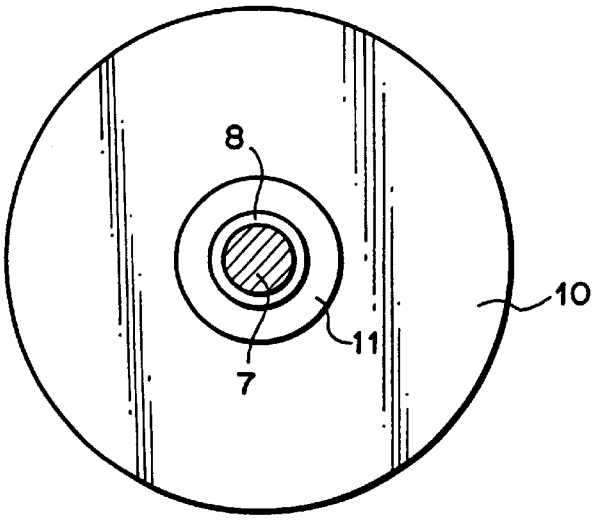
FIG. 6B is a plan view of a vibration vane in the embodiment of the vibrationally fluidly stirring apparatus of the present invention.

FIG. 6A shows a cross-sectional view of another embodiment of the vibrationally fluidly stirring apparatus of the present invention, and FIG. 6B is a plan view of a vibration vane in this embodiment.

In this embodiment, vibration motor mount plate 40 is supported on support member 18 attached to the upper edge of the tank 13 via vibration absorbing member 3 of FIG. 4C with use of bolts 33. Vibration motor 14 is mounted on the mount plate 40 via the mount member 15. Vibrating bar 7 is positioned at the center of tank 13, and the upper end of the vibrating bar 7 is secured to the mount plate 40. Circular-shaped vibration vanes 10 are used.

Figure 7:
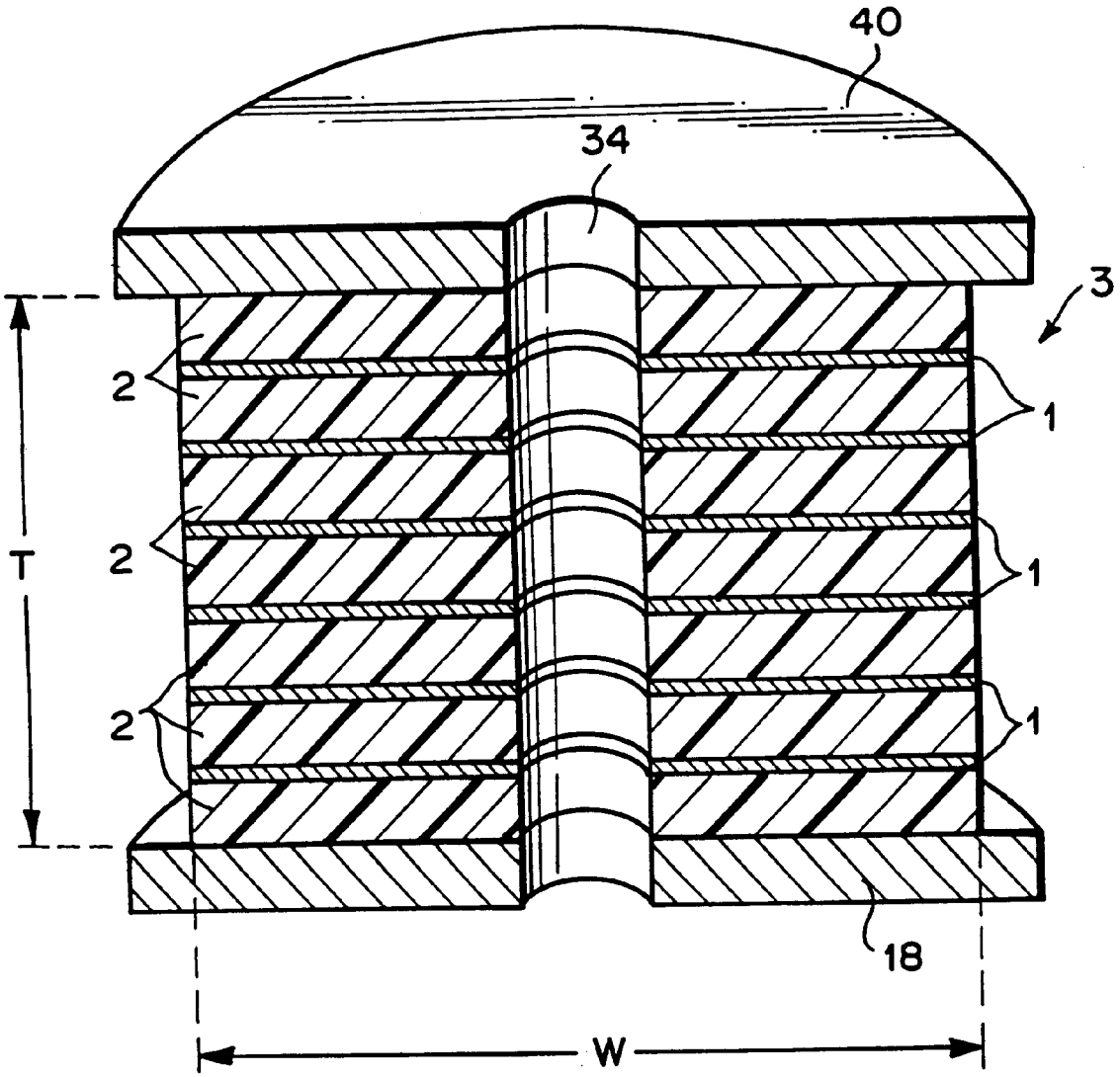
FIG. 7 shows a partially cross-sectional, perspective view of a variation of the vibration absorbing member.

FIG. 7 shows a partially cross-sectional, perspective view of a variation of the vibration absorbing member 3. It comprises seven rubber plates 2 and six metal plates 1 each being disposed between the adjacent rubber plates 2, and has circular shape. There is provided in the vibration absorbing member 3 a hole 34 through which bolt 33 shown in FIG. 6A passes. The diameter or width W thereof is preferably equal to or greater than twice the thickness T, more preferably three times the thickness T. If the width W is excessively small, the vibration absorbing member 3 is bent retative to the vertical direction and the heat generation becomes remarkably due to the friction between the vibration absorbing member 3 and the bolt.

In the present invention, it is preferable to use the vibration absorbing member 3 including 1 to 10 rubber plates.

The vibration generating portion includes a vibrator such as a vibration motor, for example electric motor, air motor, etc. As the vibrator, an electromagnet, air gun, etc. may be used. An explosion-proof type vibration motor is used in case of stirring the fluid containing flammable organic solvent.

The vibration generating portion is preferably attached to the metal plate side of the laminate. The vibration generated by the vibrator is transmitted to the vibration absorbing member 3 via the mount member 15, the mount plate 40, or the like. It is preferable to exert pressure due to the weight of the vibration generating portion on the vibration absorbing member 3, especially at an area corresponding to the support member 18 and the upper edge portion of the tank 13, as uniformly as possible.

The vibration vane 10 is preferably formed of thin metal, elastic synthetic resin, rubber or the like, and the thickness thereof may be set so that at least the tip portion of the vane 10 shows a flutter phenomenon (as if it is corrugated) on the basis of the oscillation of the vibration motor 14, whereby the oscillation is applied to the fluid in the tank 13 to cause the vibrational flow. As the material of the metal vibration vane may be used titanium, aluminum, copper, steel, stainless steel, or alloy thereof. As the material of the synthetic resin may be used polycarbonate, vinyl-chloride resin, polypropylene or the like. The thickness is not limited to a specific value, however, in order to transmit the oscillation energy and enhance the effect of the vibration, it is preferably set to 0.2 to 2 mm for metal vibration vane, and 0.5 to 10 mm for plastic or rubber vibration vane. If the thickness is excessively large, the vibrationally fluidly stirring effect is reduced. The vibrational amplitude of the vibration vane 10 is 0.5 to 20 mm for example, preferably 1 to 10 mm.

The vibration vane 10 may be secured in one stage or in multistage to the vibration bar 7. A plurality of vibration vanes such as 3 to 10 vibration vanes may be used in accordance with the size of the vibration motor 14. In the case where the number of stages is increased and the load on the vibration motor 14 is excessively increased, the vibrational amplitude is reduced and the vibration motor becomes heated. Only one vibration vane may be used.

Further, all the vibration vanes 10 may be secured perpendicularly to the vibrating bar 7 as shown in FIG. 6A. However, it is preferable that they are secured to be inclined at an angle $\alpha$ relative to a plane perpendicular to the vibrating bar 7 as shown in FIG. 1. The angle $\alpha$ is 5 to 30 degrees for example, preferably 10 to 20 degrees in (+) or (−) direction to give the directivity to the vibrational flow of the fluid.

The vibration vanes 10 are fixed to the vibrating bar 7 while pinched from the upper and lower sides by vibration vane fixing members 11 and 11' so that the flexible vibration vanes 10 is made inclined at the angle a in accordance with the shape of the lower surface of the vibration vane fixing member 11 and the shape of the upper surface of the vibration vane fixing member 11'. Plastic sheet such as fluoroplastic sheet may be interposed between the vibration vane 10 and the fixing members 11, 11'.

The vibration vane fixing member 11, 11' and the vibration vane 10 may be integrally inclined and/or bent when viewed from the side of the vibrating bar 7 in order to disperse the vibrational stress, thereby, in particular, the breakdown of the vibration vane 10 can be prevented when the vibrational frequency becomes higher.

When the vibration vanes are inclined and/or bent, lower one or two of the many vibration vanes may be inclined and/or bent downwardly while the other vibration vanes are inclined and/or bent upwardly. With this structure, the stirring of the bottom portion of the fluid in the tank can be sufficiently performed, and occurrence of traps at the bottom portion can be prevented.

Figure 8A:
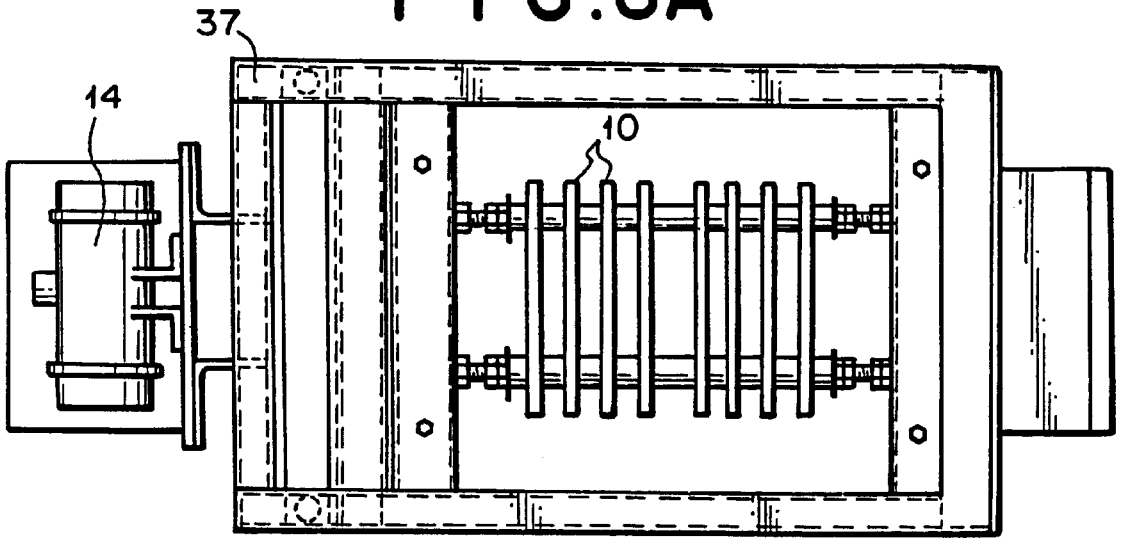
FIG. 8A is a plan view showing still another embodiment of the vibrationally fluidly stirring apparatus of the present invention.
Figure 8B:
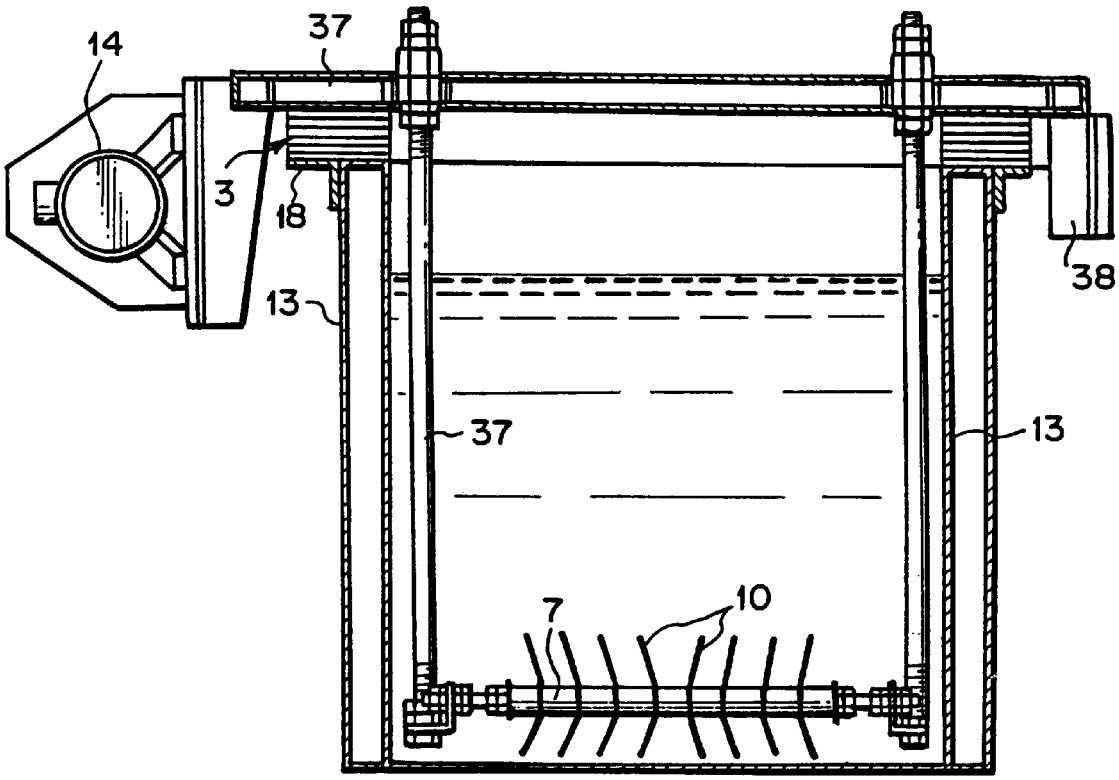
FIG. 8B is a cross-sectional view of the apparatus of FIG. 8A.

FIG. 8A is a plan view showing still another embodiment of the vibrationally fluidly stirring apparatus of the present invention, and FIG. 8B is a cross-sectional view of the apparatus of FIG. 8A.

The vibrating bar 7 and the vibration vanes 10 may be provided at the center of the tank 13 as shown in FIGS. 1 to 3 and 6, or provided at one end or both ends of the tank to cope with a large-scale tank. Further, the vibrationally fluidly stirring apparatus shown in FIGS. 8A and 8B is of such a type that the vibration vanes 10 are vibrated in horizontal direction. The vibration vanes 10 are disposed at the bottom portion of the tank 13. In FIGS. 8A and 8B, reference numeral 37 denotes an oscillation transmitting frame on which the vibration motor 14 is mounted. In this case, in order to balance the left-side weight including the vibration motor 14 and the right-side weight, balancer 38 is preferably disposed as shown in FIG. 8B. The oscillation transmitting frame 37 is mounted on the the support member 18 and the upper edge of the tank 13 via the vibration absorbing member 3.

The vibrational frequency of the vibrator is 10 to 500 Hz for example, preferably 30 to 200 Hz, more preferably 30 to 60 Hz. When the fluid is an aqueous solution having viscosity of 800 cps or less, the relationship between the output of the non-explosion-proof type vibration motor of 200 V×3 phases used as shown in FIG. 1 and the volume of the tank having regular square shape is typically those as shown in Table 1.

TABLE 1

| Output of Motor | Weight of Vibration Generating Portion | Volume of Tank | Vibrational Force |
|---|---|---|---|
| 75 [W] | 7.5 [kg] | −150 [liter] | 100 [kgf] |
| 150 [W] | 9.5 [kg] | 150–300 [liter] | 200 [kgf] |
| 250 [W] | 14 [kg] | 300–500 [liter] | 350 [kgf] |
| 400 [W] | 22 [kg] | 500–800 [liter] | 600 [kgf] |
| 750 [W] | 35 [kg] | 800–1000 [liter] | 1000 [kgf] |
| 1.2 [kW] | 52 [kg] | 1000–1500 [liter] | 1600 [kgf] |
| 1.6 [kW] | 64 [kg] | 1500- [liter] | 2300 [kgf] |
| 2.2 [kW] | 92 [kg] | | 3000 [kgf] |

Systems of the vibrating bars and vibration vanes disclosed in JP6-304461(A), JP8-173785(A), etc. can be used in the present invention.

Examples according to the present invention will be described hereunder, however, the present invention is not limited to the following examples.

EXAMPLE 1

The vibrationally stirring apparatus of FIG. 1 was used, in which the size of metal plates 1, 1' made of stainless steel (SUS304) was 300 mm×300 mm×16 mm, the size of rubber plate 2 made of chloroprene rubber was 300 mm×300 mm×30 mm, the size of tank 13 made of transparent rigid vinyl-chloride resin was 300 mm×300 mm×300 mm. The material of vibrating bars 7 was stainless steel (SUS316), the diameter thereof was 12 mm, and the two vibrating bars 7 were disposed with the interval of 80 mm. The material of spacers 8 was titanium alloy. The material of vibration vane 10 was titanium, the size thereof was 150 mm (length)×110 mm (width)×0.4 mm (thickness). The material of vibration vane fixing member 11, 11' was titanium alloy, the size thereof was 150 mm (length)×55 mm (width)×4 mm (thickness). A packing made of Teflon having the same size as the fixing member 11, 11' was interposed between the vibration vane 10 and the fixing member 11, 11' so as to prevent the breakdown of the vibration vane 10. The angle $\alpha$ was −15 degrees (downwardly) for the lowermost vane, while +15 degrees (upwardly) for the remaining upper three vanes. The vibration motor 14 was URAS VIBRATOR, KEE 1–2B (200V, 3-phase, vibrational force of 100 kgf, output of 75 W, weight of 7.5 kg: available from Yaskawa & Co., Ltd.).

The properties of chloroprene rubber used for the rubber plate 2 were those as shown in Table 2, which was determined according to the physically testing methods for vulcanized rubber defined in JIS K6301.

TABLE 2

| | |
|---|---|
| Specific gravity: | 1.42 |
| Hardness (Hs) : | 45 [degrees] |
| Tensile Strength (TB) : | 93 [kgf/cm$^2$] |
| | 9.1 [MPa] |
| Ultimate Elongation (EB): | 740 [%] |
| Tear Strength (TR): | 18 [kgf/cm] |
| | 17.8 [N/m] |

The tank 13 was charged with liquid LIQ shown in Table 3 so that the uppermost vibration vane was positioned 10 cm below the level of the liquid, and the vibration motor 14 was operated at the vibrational frequency of 50 Hz with use of an inverter (FVRC 95: manufactured by Fuji Electric Co., Ltd.). The result is shown in Table 3.

Comparative Example 1

Figure 9A:
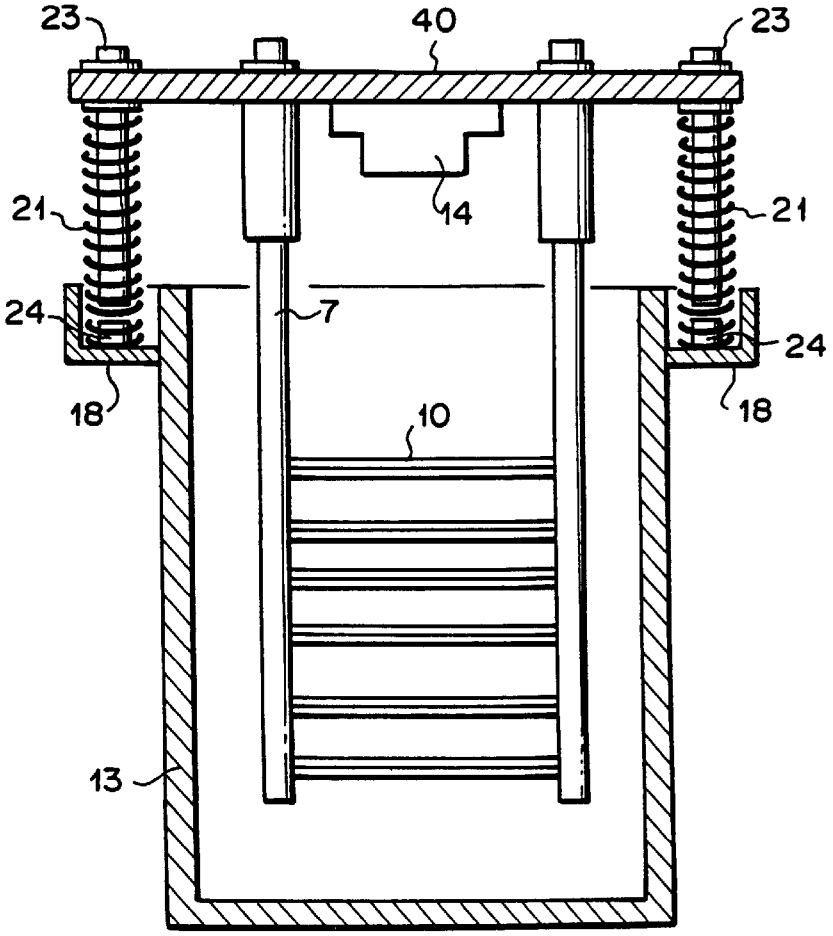
FIG.9A PRIOR ART
FIG. 9A is a cross-sectional view showing a conventional vibrationally fluidly stirring apparatus.
Figure 9B:
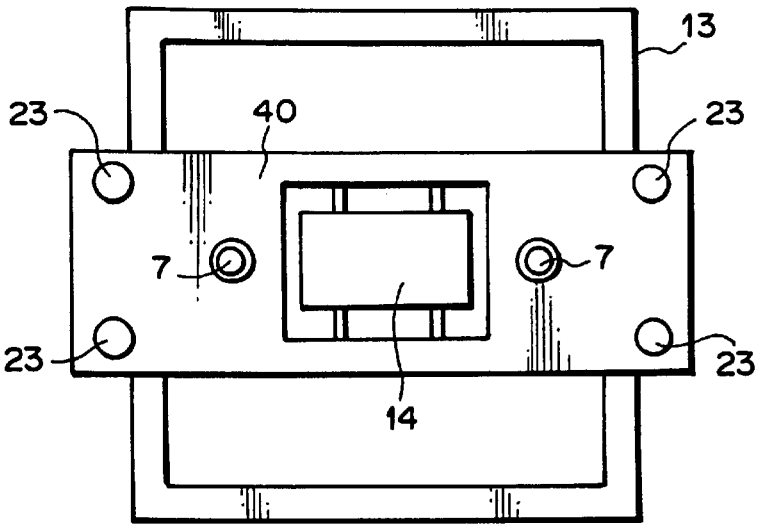
FIG.9B PRIOR ART
FIG. 9B is a plan view of the conventional vibrationally fluidly stirring apparatus.
Figure 10A:
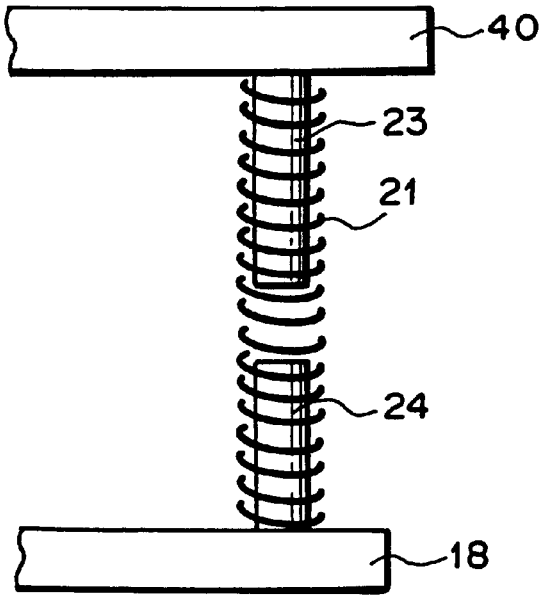
FIG.10A PRIOR ART
FIGS. 10A to 10C are a partial view of the conventional vibrationally fluidly stirring apparatus.
Figure 10B:
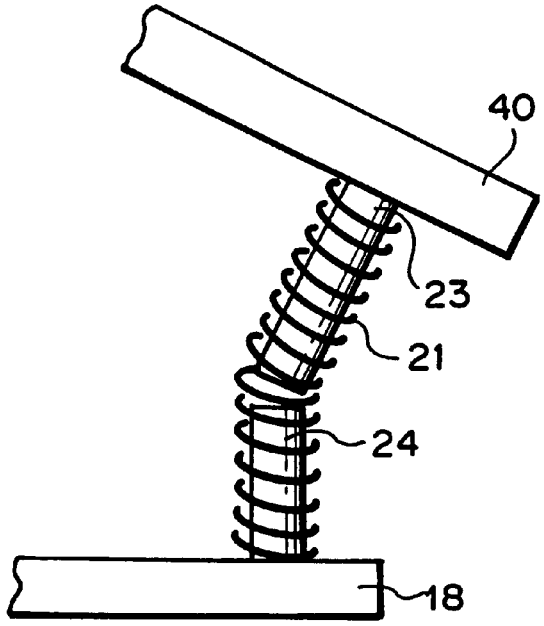
FIG.10B PRIOR ART
Figure 10C:
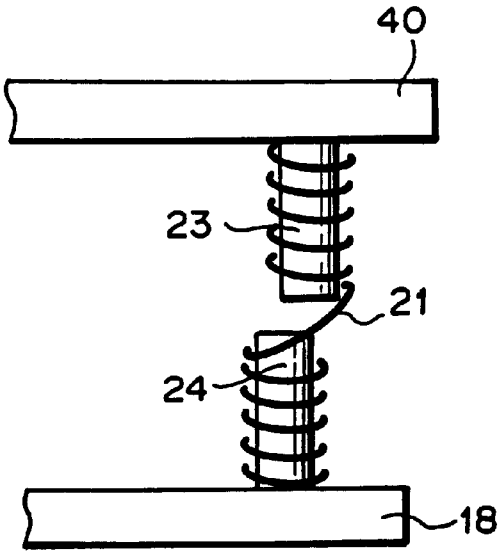
FIG.10C PRIOR ART

Example 1 was repeated except that four coiled springs shown in FIGS. 9A and 9B were used instead of the vibration absorbing member 3 made of a laminate of the metal plates 1, 1' and the rubber plate 2 of the present invention. The result is shown in Table 3.

TABLE 3

| Liquid | Example 1 | Com. Example 1 |
|---|---|---|
| Water | Liquid was not scattered to outside of tank | Liquid was scattered to outside of tank |
| Water containing 1 wt % of water soluble dye particles | Partictes were dispersed uniformly soon | Liquid was scattered to outside of tank |
| Water containing 1 wt % of hydroxyethyl cellulose | Dissolved within 30 seconds | Dissolved within 1 minute (*) |
| Water containing 5 wt % of hydroxyethyl cellulose | Dissolved within 1 minute | Dissolved within 5 minutes (*) |

(*) The vibrational frequency was lowered as compared with Example 1 so that the liquid was not scattered to the outside of the tank.

EXAMPLE 2

Example 1 was repeated except that URAS VIBRATOR, KEE 3.5-2B (200V, 3-phase, output of 250 W, weight of 14 kg: available from Yaskawa & Co., Ltd.) was used as the vibration motor 14, and the tank 13 made of stainless steel (SUS304) having the size of 300 mm×300 mm×300 mm was used. The result is shown in Table 4.

Comparative Example 2

Example 2 was repeated except that four coiled springs shown in FIGS. 9A and 9B were used instead of the vibration absorbing member 3 made of a laminate of the metal plates 1, 1' and the rubber plate 2 of the present invention. The result is shown in Table 4.

TABLE 4

| Liquid | Example 2 | Com. Example 2 |
|---|---|---|
| Water | Liquid was not scattered to outside of tank | Liquid was scattered to outside of tank |
| Water containing 1 wt % of NaOH and CMC | Dissolved within 3 minutes | Dissolved within 5 minutes (*) |
| Water containing 5 wt % of NaOH and CMC | Dissolved within 5 minutes | Dissolved within 8 minutes (*) |
| Lacquer containing 10 wt % of nitrocellulose | Dissolved within 5 minutes; No smell of lacquer at outside of tank | Dissolved within 8 minutes (*) Smell of lacquer at outside of tank; Explosion-proof type vibration motor required for preventing explosion |

(*) The vibrational frequency was lowered as compaped with Example 2 so that the liquid was not scattered to the outside of the tank.

It was found that the volume of the liquid to be stirred with use of such an apparatus as Comparative Examples 1, 2 should be about a half of that with use of such an apparatus as Examples 1, 2, because the liquid was scattered to the outside of the tank in Comparative Examples 1, 2 when the same amount of the liquid was used. Accordingly, the apparatus of Comparative Examples 1, 2 having the same size as the apparatus of Examples 1, 2 was remarkably low in treatment efficiency as compared with the apparatus of Examples 1, 2. Furthermore, the apparatus of Comparative Examples 1, 2 was noisy as compared with the apparatus of Examples 1, 2.

What is claimed is:

1. A vibrationally fluidly stirring apparatus comprising:

a tank to be charged with fluid to be stirred;

a support member fixed to an upper edge of said tank;

a vibration generating portion containing a vibration motor;

a vibration absorbing member disposed between said tank and said vibration generating portion;

a vibrating bar operationally connected to said vibration generating portion and extended in said tank; and a vibration vane attached to said vibrating bar, wherein said vibration absorbing member comprises a laminate of at least one rubber plate and at least two metal plates disposed on both sides of said rubber plate, said vibration absorbing member is attached to said support member so as to seal an upper opening of said tank, said vibration generating portion is mounted on said vibration absorbing member at a central position thereof separated from said support member, an upper portion of said vibrating bar is connected to said vibration absorbing member at the central position thereof in such a manner that said upper portion of the vibrating bar passes through a hole formed in said vibration absorbing member, nuts are engaged with said upper portion so as to fasten said rubber plate and a rubber ring positioned on one of said metal plates with said one of the metal plates interposed therebetween, and an outer surface of said upper portion of the vibrating bar is in contact with an inner face of a hole formed in said rubber plate, and, a thickness of said vibration vane is se t so that at least a tip portion thereof shows a flutter phenomenon on the basis of an oscilla tion of said vibration motor, whereby said oscillation causes a vibrational flow in said fluid in the tank.

2. The vibrationally fluidly stirring apparatus as claimed in claim 1, wherein at least one of said rubber plate comprises a sponge rubber layer and a solid rubber layer.

3. The vibrationally fluidly stirring apparatus as claimed in claim 1, further comprising an inverter for controlling said vibration motor to generate any frequency in the range from 10 to 500 Hz.

4. The vibrationally fluidly stirring apparatus as claimed in claim 1, wherein said vibration vane is made of metal, and the thickness thereof is set to 0.2 to 2 mm.

5. The vibrationally fluidly stirring apparatus as claimed in claim 1, wherein said vibration vane is made of plastic, and the thickness thereof is set to 0.5 to 10 mm.

6. The vibrationally fluidly stirring apparatus as claimed in claim 1, wherein said vibration vane is made of rubber, and the thickness thereof is set to 0.5 to 10 mm.

* * * * *

UNITED STATES PATENT AND TRADEMARK OFFICE

CERTIFICATE OF CORRECTION

PATENT NO. : 6,322,240 B1
DATED : November 27, 2001
INVENTOR(S) : Ryushin Omasa

It is certified that error appears in the above-identified patent and that said Letters Patent is hereby corrected as shown below:

Title page,
Item [73], Assignee: change "Japan Techo Co., LTD (JP)" to -- Japan Techno Co., LTD (JP) --

Signed and Sealed this

Tenth Day of September, 2002

*Attest:*

*Attesting Officer*

JAMES E. ROGAN
*Director of the United States Patent and Trademark Office*